United States Patent [19]

Kost et al.

[11] 4,159,461

[45] Jun. 26, 1979

[54] RESISTOR NETWORK HAVING HORIZONTAL GEOMETRY

[75] Inventors: Frederick H. Kost; Kermit E. Sonney; Timothy M. Kougher, all of Raleigh, N.C.

[73] Assignee: Stackpole Components Co., Raleigh, N.C.

[21] Appl. No.: 854,049

[22] Filed: Nov. 22, 1977

[51] Int. Cl.[2] ..... H01C 10/00

[52] U.S. Cl. ..... 338/195; 29/620

[58] Field of Search ..... 338/195, 320; 29/620

[56] References Cited

U.S. PATENT DOCUMENTS

| | | | |
|---|---|---|---|
| 3,573,703 | 4/1971 | Barks et al. | 338/309 |
| 3,634,927 | 1/1972 | Neale et al. | 29/620 X |
| 3,659,339 | 5/1972 | Yamaguchi | 29/620 |
| 4,032,881 | 6/1977 | Singleton | 29/620 X |

*Primary Examiner*—C. L. Albritton

*Attorney, Agent, or Firm*—Charles W. Helzer

[57] ABSTRACT

A film resistor network horizontal geometry having extended trim ratio and improved trimming and operating characteristics and method of using the same. The film resistor network comprises an insulating substrate having at least one film resistor formed thereon and a pair of opposed film conductor electrodes disposed on opposite sides of the film resistor. The side edges of the film resistor engaged by the film conductor electrodes flare outwardly from the bottom edge of the film resistor, at least on one side, and terminate in a dome-shaped top region that preferably is elongated semi-cylindrical in configuration. The dome-shaped top region is not engaged by the film conductor electrodes and the film resistor is trimmed by removal of a notch from the film resistor starting from the bottom edge and extending upwardly along a line substantially centered beneath the apex of the dome. With a film resistor thus formed, the trim ratio (TR) will conform to the expression $TR=(1+\% \Delta R/\text{laser bite})^n$ where % ΔR/laser bite is the change in resistance achieved with one pulse of the cutting laser used to trim the resistor and n is the number of laser bites.

30 Claims, 24 Drawing Figures

LASER
PULSE RATE = 5000
BITE OR STEP = 0.00025 INCHES
VELOCITY = 1.25 INCHES/SECOND
$P_{AVG.}$ = 1.5W
% ΔR PER LASER PULSE
6.0
5.0
4.0
3.0
2.0
1.0
INCHES → 0
LASER PULSES 0
.010 40
.020 80
.030 120
.040 160
.050 200
DEPTH OF d
LIMIT
$\frac{l}{w} = \frac{.006}{.060} = \frac{1}{10}$
$\frac{l}{w} = \frac{.060}{.060} = 1$
$\frac{l}{w} = \frac{.120}{.060} = 2$
$\frac{l}{w} = \frac{.180}{.060} = 3$
$\frac{l}{w} = \frac{.240}{.060} = 4$
$\frac{l}{w} = \frac{.480}{.060} = 8$

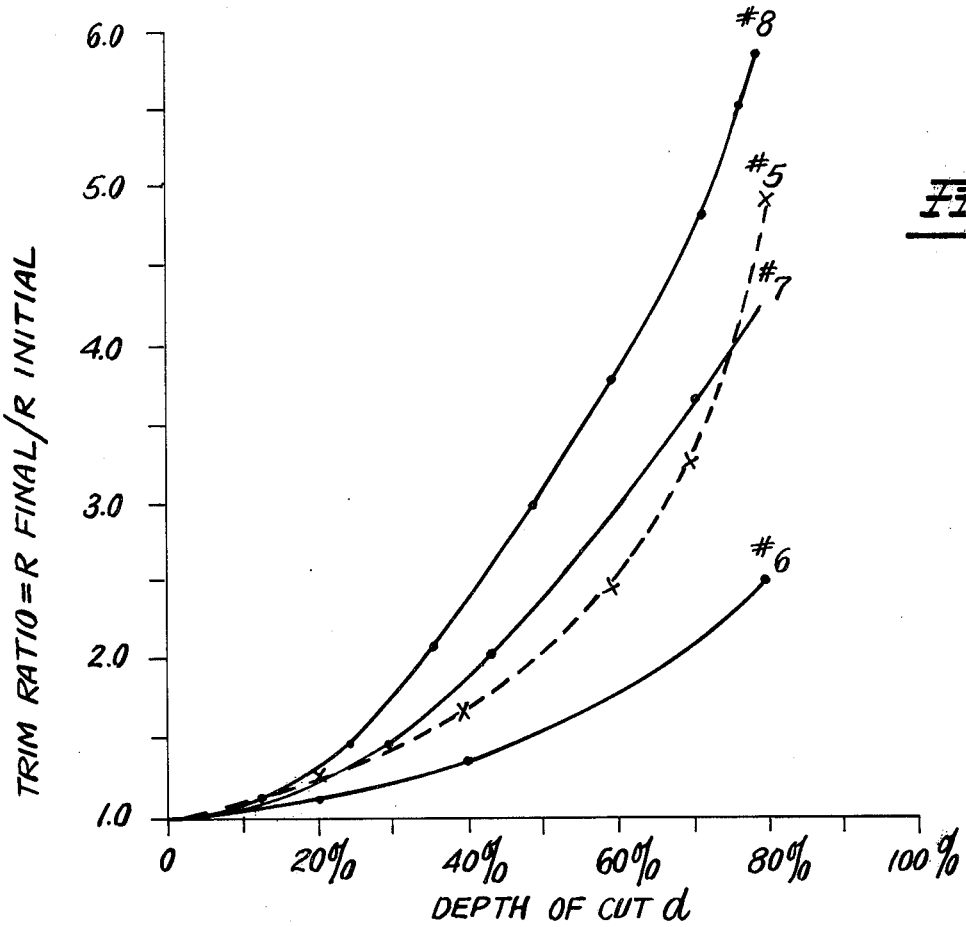
Fig. 5.
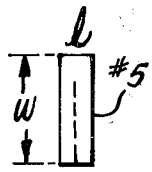
Fig. 5A.
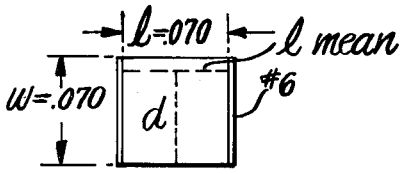
Fig. 5B.
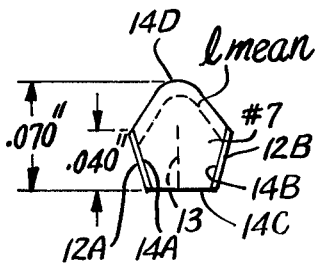
Fig. 5C.
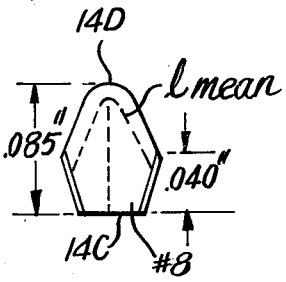
Fig. 5D.
Fig. 5E.
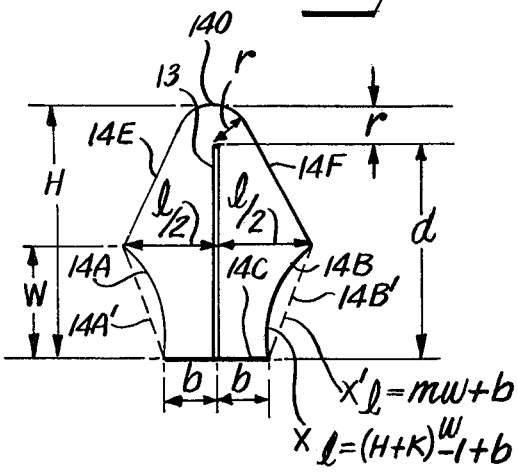

10
12A
14A
14D
14B
11
14C
12B 10
11
14D
15
12A
14A
14B
13
14C
12B
16B
16A 10
16B

CERAMIC SUBSTRATE
APPLY FILM CONDUCTOR
CURE
APPLY FILM RESISTOR
CURE
GLAZE
CURE
TRIM
APPLY TERMINALS
SOLDER
APPLY LID AND EPOXY
INSPECT AND PACK
INSPECT AND PACK

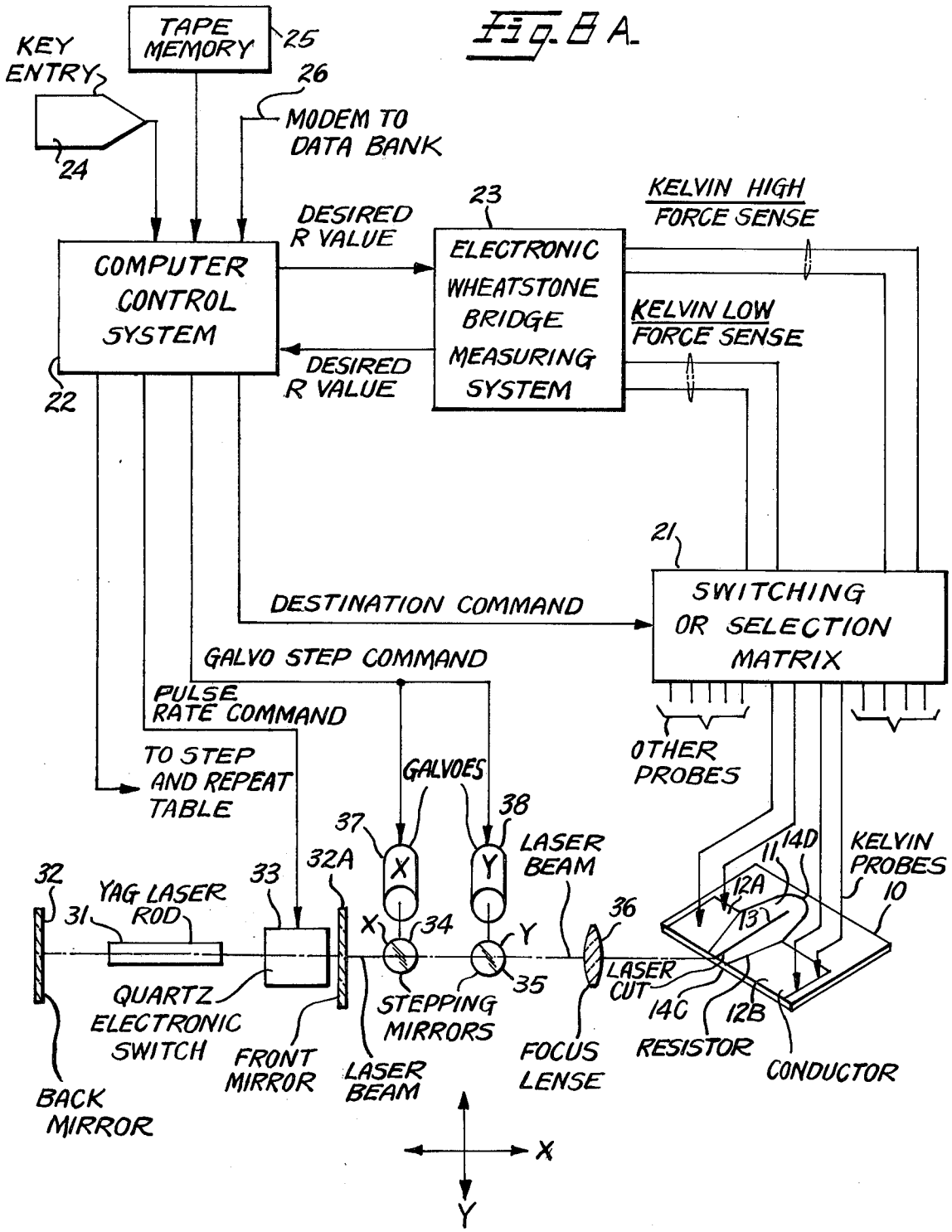
Fig. 8 A.
TAPE MEMORY
25
KEY ENTRY
24
26
MODEM TO DATA BANK
23
DESIRED R VALUE
ELECTRONIC WHEATSTONE BRIDGE MEASURING SYSTEM
KELVIN HIGH FORCE SENSE
COMPUTER CONTROL SYSTEM
KELVIN LOW FORCE SENSE
DESIRED R VALUE
22
21
SWITCHING OR SELECTION MATRIX
DESTINATION COMMAND
GALVO STEP COMMAND
PULSE RATE COMMAND
TO STEP AND REPEAT TABLE
OTHER PROBES
GALVOES
37
38
LASER BEAM
KELVIN PROBES
10
11
14D
12A
13
32
31
YAG LASER ROD
33
32A
X
34
Y
36
35
LASER CUT
QUARTZ ELECTRONIC SWITCH
STEPPING MIRRORS
14C
12B
RESISTOR
CONDUCTOR
FRONT MIRROR
LASER BEAM
FOCUS LENSE
BACK MIRROR
X
Y

RESISTOR NETWORK HAVING HORIZONTAL GEOMETRY

BACKGROUND OF INVENTION

1. Field of Invention

This invention relates to fabrication of film resistors having improved trimming properties and operating characteristics and while it is described with particular reference to thick film resistors, the invention is not so restricted and also may be used in the fabrication of thin film resistor networks.

More specifically, the invention relates to film resistors having new and useful horizontal geometry and their method of manufacture to provide film resistor networks which possess higher trim ratios for resistors of given dimensions, allow greater throughput and higher yields, and produce film resistor networks which possess superior operating characteristics after trimming.

2. Background Problem

FIG. 1 is a schematic illustration of the horizontal geometry of a film resistor network which is used substantially throughout the film resistor industry as evidenced by the teachings of U.S. Pat. No. 3,573,703 and U.S. Pat. No. 3,947,801, for example. As illustrated in FIG. 1, the effective length of the film resistor shown as 11 is identified by the letter l, the width of the film resistor by the letter w, the depth of a laser trimming cut 13 by the letter d, and the centering of the laser cut 13 by the letter c. The termination region comprised by electrode conductors 12A and 12B overlap a portion of the film resistor as shown by dotted lines 14A and 14B to insure a good conductor to resistor interface and these overlap regions are essentially a conductive region and do not enter into the resistance calculations. In reality, the overlap regions do affect the resistance value, but such effect is outside the scope of this disclosure and does not negate any of the following considerations. For the purpose of the following disclosure, the interface between the non-overlapped areas of film resistor 11 with the overlap regions as shown at 14A and 14B shall be defined as the side edges of the resistor film, the lower edge 14C where the laser cut or notch 13 is formed shall be considered the bottom and the upper edge 140 shall be considered to be the top region of the resistor film. The substrate upon which such resistor films normally are formed has not been shown merely for the purpose of simplifying the illustration.

For any given sheet resistivity of a film resistor such as shown at 11, the resistance is determined essentially by the length divided by the width ($R=l/w$). This statement, however, defines a boundary condition which applies only when l is much larger than w or when the width of the notch d is equal to the length l. The latter case does not occur in the instant disclosure because the resistor films herein described are trimmed by laser beam cutting and the width of the laser beam cut or notch is approximately 0.002 inches (2 milli-inches).

The integrated circuit (IC) products which were first introduced on a commercial scale in the electronics industry in the early 1960s developed from small scale integration (SSI > 10 circuits) to medium scale integration (MSI > 50 circuits) to the more recently introduced large scale integration (LSI > 100 circuits) techniques. These semiconductor IC circuits have been produced by the tens of billions and although the functions and circuit applications continually change there has been standardization of packaging of such circuits. The so called dual-inline-package (DIP) or originally the TO-116 package is so firmly entrenched in the electronics industry that all major manufacturer's packages have been made to be physically interchangeable in addition to being made compatible with the same automatic insertion equipment.

The passive components manufacturers (resistors, capacitors, inductors, etc.) classically have been producing discrete devices for use in electronic circuits. During the past six years, however, there has been emphasis on replacing discrete components with integrated circuit devices particularly where the application is iterative in nature. The name which has become prevalent for integrated passive components is "networks". For such IC passive components, such as resistor networks, the types of circuits and of course their component values vary but the package in which the networks are sold and used have to be standardized for interchangeability as mentioned above. At the present time there is increasing emphasis on the implementation of the dual-inline package (DIP) and the single-inline-package (SIP). The SIP also has been standardized in terms of lead spacing (0.100 inches) and height above the circuit board namely 0.350, 0.250 and 0.200 inches. The latter dimensioning has given ground to less than 0.185 inches to be compatible with the maximum DIP height of 0.185 inches to provide interchangeability between SIPs and DIPs.

The above-discussed miniaturized packages along with standard circuits, power, voltage, temperature coefficient of resistance, laser trimming techniques, etc. have placed constraints on the network design, network layout (horizontal geometry) and materials. To meet these constraints, and yet provide reliable operationsl resistor networks which can be economically produced, the present invention was devised.

SUMMARY OF INVENTION

It is therefore a primary object of the invention to provide new and useful film resistor networks having novel horizontal geometry which provides the film resistor with higher trim ratios than heretofore obtainable with conventional resistor geometry of given physical dimensions and which possess superior operating characteristics after trimming.

Another object of the invention is to provide improved film resistor networks having novel horizontal geometry as set forth above and the method of use thereof to greatly improve throughput during manufacture and trimming and resulting in increased yields from any given batch processing operation during manufacture resulting in better temperature coefficient of resistance (TCR) tracking characteristics for larger numbers of such film resistor networks produced from a single batch processing operation during manufacture.

In practicing the invention, a novel film resistor network geometry is provided having improved trimming characteristics and comprises an insulating substrate having at least one film resistor formed thereon and a pair of opposed film conductor electrodes disposed on opposite sides of the film resistor. The side edges of the film resistor engaged by the film conductor electrodes flare outwardly from the bottom edge of the film resistor, at least on one side thereof, and terminate in a dome-shaped top region of the film resistor which is not engaged by the film conductor electrode and the film resistor is trimmed by cutting a notch in the film resistor from the bottom edge thereof. The notch cut in the film resistor for trimming purposes preferably is in the form of a fine slit or cut about 2 miliinches wide produced by laser beam cutting commencing at the bottom edge and extending upwardly toward the top of the film resistor along a line substantially centered beneath the apex of the dome-shaped top region. Where space constraints permit, and the range of resistance values to be obtained require extension of the trim ratio (TR) to maximum values, the dome-shaped top region of the film resistor is elongated to a semi-elliptical configuration. By this means, the film resistor is provided with a trim ratio (TR) exhibiting a characteristic in accordance with the following expression $TR=(1+\%\ \Delta R/\text{laser bite})^n$ where % ΔR/laser bite represents the change in resistance of the film resistor produced by each cutting laser beam pulse or bite and n is the number of laser bites, and wherein the % ΔR/laser bite is substantially constant over a required range of laser bites necessary to give a maximum value of trim ratio (TR) for a given value of starting resistance for a film resistor of given dimensions and having the above set forth resistor network horizontal geometry. In preferred forms of the invention, the outwardly flaring side edges of the film resistor conform substantially to a configuration defined by the power function $y^x$ as it approaches a limiting straight line condition defined by the expression $x_1=(1+K)^w-1+b$ where $x_1$ is the abscissa and w is the ordinate of the curve defined by the edge of the film resistor, K is a constant and b is ½ the base of the film resistor.

In certain preferred forms of the invention, there are a plurality of similarly shaped film resistors formed on a single substrate and interconnected in a resistor network by appropriate film conductors formed on the substrate along with the film resistors and their associated film conductor electrodes. The film resistor network and interconnecting conductors thus formed may be encapsulated in a fired glass protective coating and terminals mechanically and electrically connected to the film conductor electrode with or without the addition of soldering. In certain other embodiments of the invention, a lid comprised by an additional substrate member is disposed over the film resistor network and associated film conductor covering one surface of the first mentioned substrate in the manner of a sandwich structure and terminals are mechanically and electrically connected to the film conductor electrodes with or without soldering.

The new and improved method of manufacturing and trimming film resistor networks having the improved horizontal geometry described above is carried out by cutting a fine slit, notch or kerf completely through the film resistor with a pulsed laser beam starting from the bottom edge of the film resistor and extending along a line substantially centered under the apex of the dome-shaped top region of the film resistor. The trimming fine slit, notch or kerf thus provided to the film resistor may extend substantially across the width of the film resistor up to approximately 80% of the width dimension and as the trimming notch or kerf becomes deeper, the conductive characteristics of the trimmed resistor film become improved due to the improvement and elongation of the effective current carrying conductive path through the trimmed resistor film. By this means improved trim ratio for the film resistors is obtained along with a substantially constant rate of trimming both at the beginning and at the end of the trimming notch and the mean length of the effective resistor is in effect increased with increasing trim depth.

BRIEF DESCRIPTION OF DRAWINGS

These and other objects, features and many of the attendant advantages of this invention will be appreciated more readily as the same becomes better understood from a reading of the following detailed description when considered in connection with the accompanying drawings, wherein like parts in each of the several figures are identified by the same reference character, and wherein:

FIG. 3 is a graph plotting the percent change in resistance (% ΔR) per laser pulse versus the depth of cut (d);

FIGS. 5A–5D illustrate four different film resistor horizontal geometries whose characteristics are plotted in FIG. 5;

FIG. 5E illustrates an idealized film resistor horizontal geometry according to the invention together with a number of dimensional parameters employed in producing the geometry;

FIG. 6 is a characteristic curve plotting the trim ratio versus depth of cut characteristic of the film resistor network horizontal geometry shown in FIGS. 4A–4D and 5A–5D in a common plot;

FIGS. 8 and 8A are schematic block diagrams of the method of fabrication and apparatus, respectively, for fabricating and trimming novel film resistor network horizontal geometries according to the invention;

FIG. 11 is a planar view of the layout of the miniature single-inline-package (Mini-SIP) film resistor network design according to the invention;

FIG. 12 is a planar view of a single element film resistor network employing the novel horizontal geometry according to the invention and shows the attachment of terminal leads thereto; and FIG. 13 is an end view of the film resistor network shown in FIG. 12.

DETAILED DESCRIPTION OF PREFERRED EMBODIMENTS

Like the semiconductor integrated ciricut, film resistor networks are produced by a batch process such that plus or minus 20% variation in initial resistance value is not uncommon and is considered necessary in order to keep cost down and volume up. With the advent of computer controlled laser trimming, the resistors at a later step are tailored to a precise resistance value of less than 1% nominal rated value. This has proven economical in practice since it is not unusual to laser trim in excess of 36,000 resistors per hour as opposed to older abrasive trimming methods (such as that described in U.S. Pat. No. 3,594,679) whereby only approximately 1,000 resistors per hour can be trimmed. In addition, the laser cut employed in trimming the resistors is only 0.002 inches wide in comparison to abrasive cuts of 0.2 inches in width or wider. Thus the speed of trimming is up by a factor of 300 and the geometry down by a factor of 10 paving the way to practical miniaturization and higher resistor density if such film resistor networks are to be marketed in DIP and SIP packages.

It is practically impossible to control the blend of the resistor material used in forming the film resistor so that there is identity in resistance value from one batch processing operation to the next. This simple fact of life makes it highly desirable to provide film resistor network horizontal geometries which make it possible to obtain high trim ratios for ease of production, higher yields and greater throughput from a single resistivity material blend employed in any given batch processing operation. Additionally, high trim ratios are desirable in order to provide multiple resistor values on a single film resistor network substrate using the same resistivity material blend so that such multiple resistor values do not require multiple batch processing using different resistivity material blends. Finally, the effective lot size of finished film resistor networks obtained from a given batch processing operation is proportional to the trim ratio as will be explained more fully hereinafter.

Figure 2:
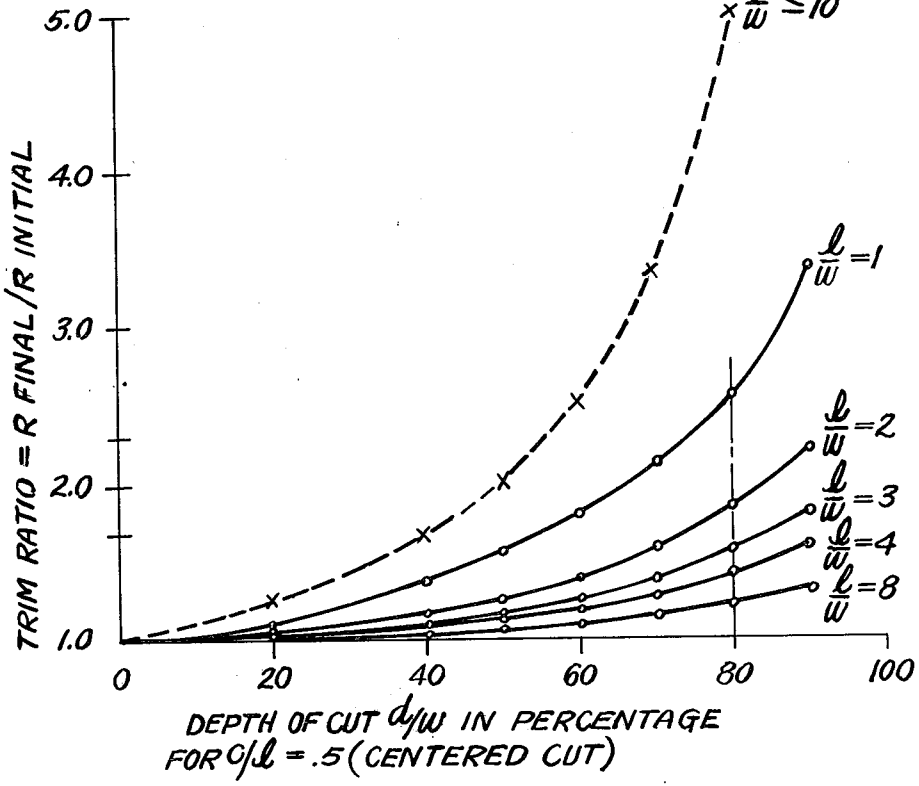
FIG. 2 is a graph illustrating the trim ratio (R final/R initial) versus depth of cut (d/w in percentages) characteristics of the prior art film resistor networks trimmed as shown in FIG. 1 for a center cut condition (c=0.5 w) for a number of l/w ratios.

The graph shown in FIG. 2 illustrates the trim ratio versus depth of cut d for a variety of l/w ratios. As explained in the introductory portions of this specification, the resistance of any film resistivity is determined by the length l divided by the width w ($R=l/w$). The trim ratio is defined to be the value of the sheet resistivity R after trimming divided by the value of the film resistivity before trimming (R final/R initial). The dashed line labeled $l/w \leqq 1/10$ in FIG. 2 defines the ratio is shown to have a value of 5 to 1. This, however, is not a practical arrangement in standard resistor networks because of the type of packaging that is used. Both dual inline packages (DIP) and single inline packages (SIP) have physical dimensions which place constraints on the l/w ratios. Because of these packaging constraints, l/w ratios of 1, 2 and 3 are most common and will be l/w ratios of 1, 2 and 3 are most common and will be used for purposes of comparison later on in this specification. In virtually all real applications, thick film resistor compositions require that at least 0.015 inches of material remain after trimming. In other words, d must, of necessity, not exceed (w−0.015 inches) hence the largest practical w in the industry accepted standard DIPs and SIPs is approximately 0.080 inches and therefore the maximum value of d cannot exceed 0.080 inches minus 0.015 inches equals 0.065 inches. Since 0.065 divided by 0.080=80%, the maximum practical depth for any given film resistor network configuration would be when d/w=80%. Referring back to the graph shown in FIG. 2, various trim ratios at the 80% point for different l/w ratios are shown to be as follows:

TR=2.5 when l/w=1
TR=1.8 when l/w=2
TR=1.6 when l/w=3
TR=1.4 when l/w=4
TR=1.2 when l/w=8

From the above listing it is obvious that the trim ratio TR decreases as the l/w increases. This occurs because of spreading of the voltage gradient at the conductor terminations and is characteristic of film resistor networks. This spreading effect of voltage and current at the electrode terminations produces problems in the production of film resistor networks and also degrades the electrical and thermal properties of the completed product.

Thick film resistor processing is a technology which by definition varies such that the initial resistance of the completed and fired film resistor networks prior to trimming, can vary in a "lot" or "batch", from "lot" to "lot" or "batch" to "batch", as much as plus or minus 25%. This variation is an accepted norm and is, of course, the primary reason that the film resistor networks are trimmed to increase the resistance value until it is within approximately 1% of the nominal rated value of the network. For example, if the desired or nominal rated value of a film resistor network is 100 ohms, the resistivity of the resistor material chosen in fabricating the network such that after processing of many thousands of resistor networks, the mean value of resistance would be 80 ohms and three or more standard deviations would be plus or minus 20 ohms. Thus, the pre-trim process variations would result in resistance values from 60–100 ohms. This type of distribution guarantees that all units can be trimmed to the desired 100 ohm nominal rated value. The minimum trim ratio TR to accomplish this would be 100/60=1.67. Referring back to FIG. 1, it can be seen from this graph that an l/w ratio for the film resistor network would have to have a value of 2 or less otherwise the resultant pre-trimmed film resistor networks would have an inadequate trim ratio.

A more practical problem will be appreciated by referring to the following table of standard resistance values of film resistor networks manufactured and sold by a number of manufacturers and typical of standard resistance values required for such networks throughout the electronics industry.

| Standard Resistance Values (Ω's) | | | | | | | | | |
|---|---|---|---|---|---|---|---|---|---|
| 33 | 100 | 330 | 1.0K | 3.3K | 10K | 33K | 100K | 330K | 1MEG |
| 39 | 120 | 390 | 1.2K | 3.9K | 12K | 39K | 120K | 390K | 1.2MEG |
| 47 | 150 | 470 | 1.5K | 4.7K | 15K | 47K | 150K | 470K | 1.5MEG |
| 56 | 180 | 560 | 1.8K | 5.6K | 18K | 56K | 180K | 560K | 1.8MEG |
| 60 | 200 | 600 | 2.0K | 6.0K | 20K | 60K | 200K | 600K | 2.0MEG |
| 68 | 220 | 680 | 2.2K | 6.8K | 22K | 68K | 220K | 680K | 2.2MEG |
| 82 | 270 | 820 | 2.7K | 8.2K | 27K | 82K | 270K | 820K | 2.7MEG |

From a consideration of the standard resistance values table listed above, it will be appreciated that standard resistance values run from 100, 120, 150, 180, 200, 220, 270 etc. Referring back to FIG. 2 it will be seen that if l/w the aspect ratio=1, the maximum trim ratio TR at the 80% point would be 2.5. 2.5 times 60 ohms=150 ohms. Thus, such an l/w aspect ratio could be used only to guarantee three standard resistance values, namely 100, 120 and 150 ohms. If the l/w aspect ratio had a value l/w=2, the trim ratio TR would be 1.8, when d=80% and the maximum guaranteed value then would be 60 ohms times 1.8 or 108 ohms and only the 100 ohm standard resistance value could be satisfied. In contrast, had the trim ratio TR been 5, 7 of the standard resistance values could have been covered, and if TR=10, 12 of the standard resistance values could have been covered. Thus, it will be appreciated that higher trim ratios assure hitting target values with greater ease and the merging of "lots" or "batches" of different values to increase the volume and reduce losses. Both of these capabilities result in higher yield, lower cost and ease of manufacture since the laser trimmer used to trim the resistor networks to their final value is computer controlled and a decision of what value to trim to is a very simple programmed change on the computer. In addition, the computer controlled laser trimmer can be programmed to make that decision by itself. With such an arrangement, the computer-laser system does a pretest to determine if a unit is trimmable to a desired value and if not, it can select the next higher value.

From a practical point of view, keeping in mind the industry accepted standard package size for DIPs and SIPs, the length l for any given film resistor network element is determined by the number of film resistor networks to be included in the package. For instance, in a 16 pin, 15 resistor element DIP, l=0.070 inches. In a 16 pin, 8 resistor DIP, l=1.140 inches. Thus, for these examples, l/w would be 1 and 2, respectively, if w=0.070 inches. Referring again to FIG. 1, the maximum trim ratio TR of a resistor network element if w=0.070 inches would occur at d=80% in order to leave the required 0.015 inches of resistivity material remaining. To satisfy this requirement, for the examples noted above, for l/w=1 then TR=2.5 and for l/w=2, TR=1.7. Only a cursory consideration of these values, is required to appreciate that the range of standard resistance values obtainable by subsequent trimming are severely limited and are intolerant to high speed manufacturing since they would require meticulous care in the selection of the resistivity of the resistor compositions employed in fabricating the networks. This is a particularly severe problem, if the network, because of its intended application, requires a wide range of resistor values.

With reference now to FIG. 3 of the drawings, this graph shows the rate of change of resistance per laser pulse (% ΔR/laser pulse) as a function of the depth of the laser cut d. In developing these characteristic curves, a laser pulse rate of 5,000 pulses per second was used with each pulse being stepped 0.00025" and at a velocity of 1.25" per second and an average power per pulse of 1.5 watts. Recalling that the generally desired tolerance for the finished resistance value is in the neighborhood of 1% of the nominal rated value of the resistor, it will be seen from the graphs shown in FIG. 3 that for the prior art film resistor horizontal geometry shown in FIG. 1, the rate of change of resistance (% ΔR) starts out very small and then begins to increase more rapidly as the limit of d is approached. This situation becomes more meaningful if it is considered in terms of laser pulses under actual operating conditions. Assuming the above set-forth parameters for the pulsed laser beam during trimming, then it will be noted that the first 40 laser pulses produce less than 0.2% change or 0.005% change in resistance per laser pulse. This is a very inefficient use of the pulsed laser beam cutting system and causes a very low throughput. Since the ultimate target value is approximately 1% of the nominal rated value of the finished resistor, a more ideal rate of change would be in the neighborhood of 1% change in resistance for each laser beam pulse. Achievement of this end would increase the trimming speed by a factor of 1% per laser pulse divided by the present 0.005% per laser pulse resulting in an increase of the trimming rate by a factor of 200. In addition, it will be noted from the curves of FIG. 3 that as the final trimmed value in terms of depth of d is approached, the rate of change of resistance per laser pulse increases steeply as exemplified by a configuration where the l/w ratio=1, for example. This steeply increasing rate of change of resistance for each laser pulse complicates final trimming to within the desired 1% of nominal rated value and may even require the inclusion of an additional vernier cut or someother complicating additional operation.

Figure 1:
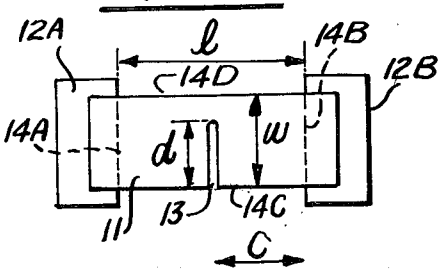
FIG. 1. PRIOR ART
FIG. 1 is a schematic illustration of the horizontal geometry of a prior art film resistor network that has been trimmed in a known manner.
Figure 2A:
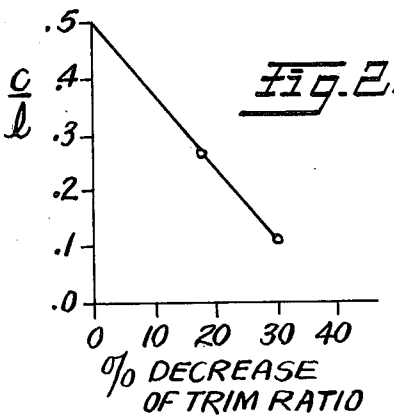
FIG. 2A is a graph showing the percent decrease of trim ratio for changes in the position of the notch distance c relative to the length l (c/l)

For the purpose of analyzing the power and thermal conditions encountered with the prior art film resistor horizontal geometry as shown in FIG. 1, assume a specimen having an l/w=1 and d=0 wherein the area of the resistor=l×w=0.060×0.060=0.0036 square inches. At a recommended power density of 100 watts per square inch, which is a common maximum standard for thick film resistor compositions in the industry, the power capacity of the untrimmed resistor equals 0.0036 inches squared times 100 watts per square inch=0.360 watts. While this is an adequate power level, it is not too practical since virtually all resistors require trimming to accommodate plus or minus 25% process spread.

The power capacity of the fully trimmed resistor example stated in the preceeding paragraph will be given by 0.015"×0.070"×100 watts per sq. in.=0.105 watts. A resistor of these dimensions is used by many manufacturers in the industry on the standard 16 pin, 15 registor DIP network package. All of the data sheets of such manufacturers specify 0.125 watts minimum, as do other standards such as Military Standard 202 for defining desired characteristics for film resistor networks. The power really should be guard banded to at least 0.150 watts. In order to maintain 0.150 watts with these prior art structures, d must be limited to 0.048". Thus (w−d)l×watts per sq. in.=(0.070"−0.048")×0.070"×100 watts per sq. in.=0.150 watts. Accordingly, in order to meet the power requirement of 0.150 watts, the fully trimmed resistor results in a little d/w ratio of d/w=0.048"/0.070"=68%. By referring to FIG. 2 of the drawings, it will be seen that the 68% d/w ratio limits the trim ratio for a resistor having the configuration l/w=1 to a value TR=2.1 and if l/w=2 then TR=1.55. From a consideration of these values, it will be appreciated that the more that this prior art film resistor horizontal geometry is trimmed, the worst it gets in terms of power handling capability, which in turn limits the depth of cut and consequently the trim ratio. Also, as the area of this prior art configuration decreases with the depth of cut d, the power is dissipated over a smaller and smaller area causing corresponding increase in temperature of the active resistor film. This higher temperature limits the operating range and also may cause a self-induced change in resistance value or tolerance due to change in temperature coefficient of resistance. These points have been addressed before as exemplified by the paper entitled "Power Rating Prediction and Evaluation in Thick Film Resistor"—Kirk A. Snodgrass, reported in the 1976 Proceedings of the Interntational Microelectronics Symposium on pages 2–6, published by the International Society for Hybrid Electronics (ISHM)-P. O. Box 3255-Montgomery, Alabama.

In order to overcome the above-discussed difficulties encountered with the prior film resistor network horizontal geometry, the present invention was devised as will be explained more fully hereinafter in conjunction with FIGS. 4 and 5 of the drawings and their associated FIGS. 4A–4D and FIGS. 5A–5E.

Figure 4:
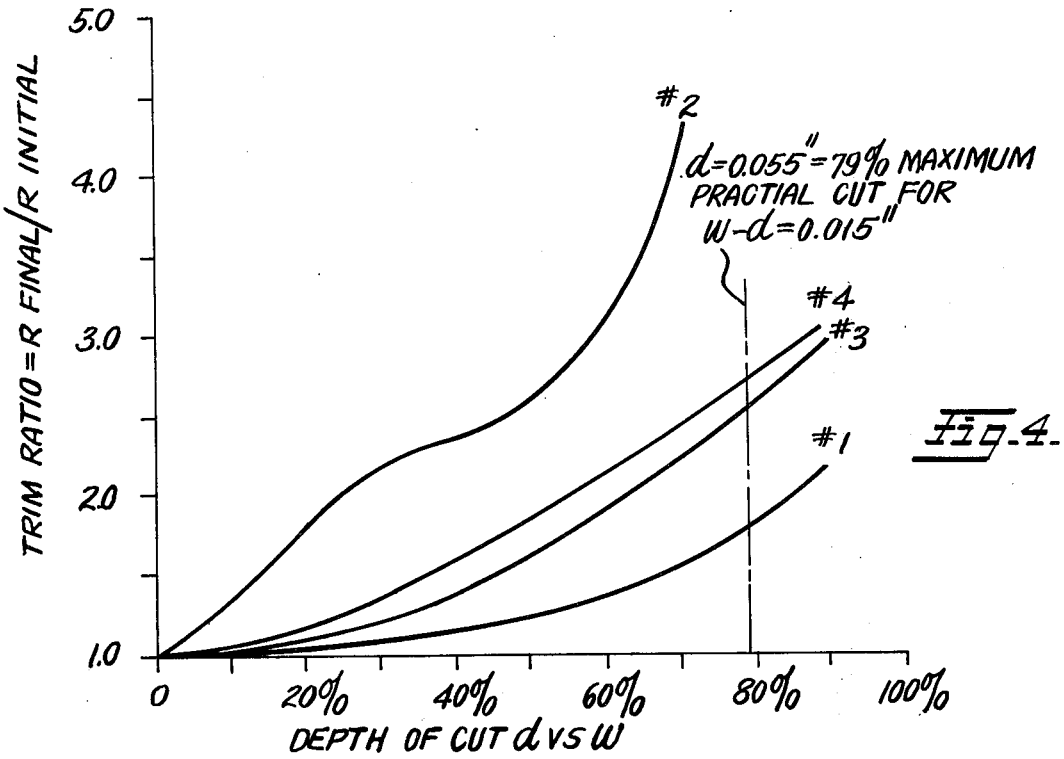
FIG. 4 is a characteristic curve plotting the trim ratio versus the depth of cut d characteristic for the four horizontal geometric configurations shown in FIGS. 4A–4D.
Figure 4A:
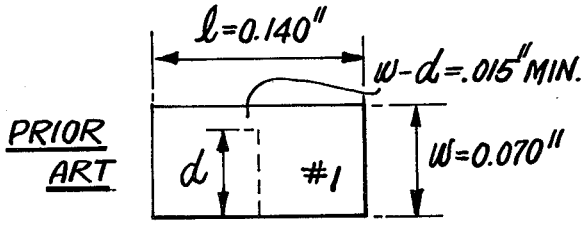
FIGS. 4A–4D illustrate four different film resistor horizontal geometries whose characteristics are plotted in FIG. 4.
Figure 4B:
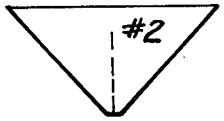
Figure 4C:
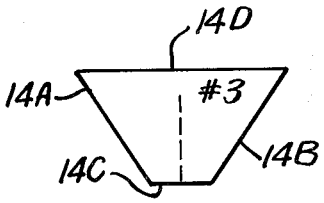
Figure 4D:
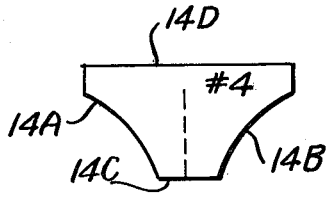

FIG. 4 is a plot showing the trim ratio TR=R final/R initial characteristics of four film resistor horizontal geometries illustrated in FIGS. 4A–4D and plots the trim ratio TR versus the depth of cut d as a percentage of the width w. FIG. 4A illustrates the conventional two square prior art film resistor horizontal geometry wherein l/w=2, l=0.140", w=0.070", and w−d=0.015" minimum. The TR versus depth of cut d in percent of w characteristic of FIG. 4A is shown as curve #1, FIG. 4B as curve #2, FIG. 4C as curve #3 and FIG. 4D as curve #4 in FIG. 4. From a consideration of curve #1 in FIG. 4 it will be seen that the horizontal geometry of FIG. 4A results in a trim ratio TR=1.8 (d=80% in order to provide the minimum w−d=0.015" value. In other words, with this size and horizontal geometry a maximum practical trim increases the initial resistor value by only 80%. The film resistor horizontal geometry shown in FIG. 4B characteristics plotted as curve #2 in FIG. 4, is a conceptualized ideal geometry which results in a maximum trim ratio of approximately TR=6 when d=80%. Such a geometry therefore would increase the initial resistance by 600%. However, this is an unrealistic horizontal geometry for a film resistor since the length of the bottom of the film resistor is only 0.010" maximum and a minimum of 0.020" is required in practice for all film resistor horizontal geometries. Resistor #3 shown in FIG. 4C is a compromise between resistors 1 and 2 and is a practical design. The film resistor shown in FIG. 4C has a top edge 14D=0.140" and a bottom edge=0.040" and provides a trim ratio of 2.5 at d=80% as shown by curve #3 in FIG. 4. Thus, the resistance of this horizontal geometry was increased by 150% after trimming to the maximum extent over the initial resistance value. Resistor #4 shown in FIG. 4D is similar to #3 except that the terminations (side edge intercepts of the film resistor with the film conductor electrodes) are curved to a power function $y^x$ power. This shape causes the initial rate of change of resistance % ΔR to increase over that of the configuration shown in FIG. 4C resulting in a slightly higher trim ratio as shown in curve #4 of FIG. 4. The objective in going to the configuration of FIG. 4D is to obtain a more uniform rate of change of resistance % ΔR with changes in d.

From the above discussed considerations, it will be appreciated that both the resistor configurations of FIG. 4C and FIG. 4D are practical devices for significantly increasing the magnitude of resistance change during trimming while reducing the amount of resistor composition required in fabricating the film resistors. Note that the percent change in resistance value of the prior art resistor shown in FIG. 4A is 1.8−1 or 80%. The change in resistance during trimming for the resistor configuration shown in FIG. 4C is 2.5−1 or 150%. This is a trim ratio improvement of 2.5/1.8=1.39 resulting in an improvement by a factor of 1.39. The percentage of resistance change as a result of going to the horizontal geometry of FIG. 4C is improved by 150%/80%=1.88 or by a factor of 1.88. With the resistor configuration shown in FIG. 4D, the trim ratio is improved over that of FIG. 4A by a factor of 2.8/1.8=1.55 and the percentage change in resistance by 180%/80%=2.25. From these considerations, it will be appreciated that considerable improvement in performance and extended trim ratio can be obtained by going to the horizontal geometry configurations depicted in FIGS. 4C and 4D. However, these geometries alone do not result in a greatly extended trim ratio. For this reason, it is desirable to modify the geometry further in the manner depicted in FIGS. 5A–5E as discussed with relation to FIG. 5.

Figure 5:
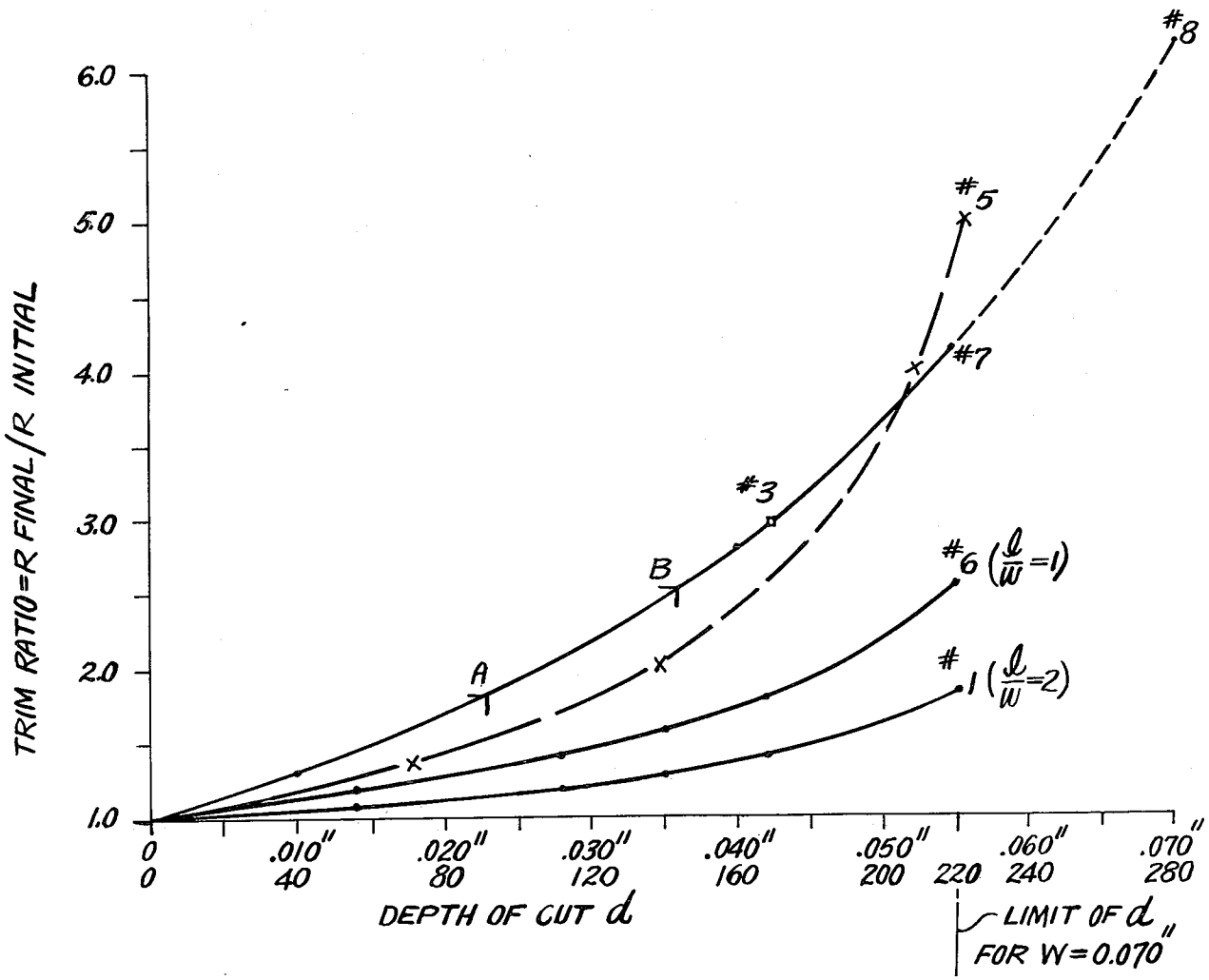
FIG. 5 is a characteristic curve plotting the trim ratio versus depth of cut d characteristics for the four film resistor network horizontal geometries shown in FIGS. 5A–5D.

FIG. 5A illustrates a film resistor horizontal geometry which depicts a conceptually idealized rectangular resistor #5 whose l/w ratio=1/7=0.14. Ideally, a film resistor having this configuration would have a trim ratio TR=5 at d=80%. The resistor of FIG. 5A is not a practical film resistor geometry for use in standard DIP and SIP packages for the same reason as the resistor depicted in FIG. 4B in that 1 becomes too small for practical applications. The film resistor geometry shown in FIG. 5B is a standard prior art geometry where l/w=0.070"/0.070"=1 and is referred to in the art as one square. If d=80%, the trim ratio of the film resistor shown in FIG. 5B is 2.5 as shown by curve #6 in FIG. 5.

A film resistor horizontal geometry which possesses the improved characteristics of the configuration of FIG. 4C and 4D and which also includes the extended trim ratio TR of the FIG. 5A configuration, is illustrated in FIG. 5C and is so shaped that it provides a constant rate of change of resistance value % ΔR per laser bite and results in increased trim ratio TR. To achieve these characteristics, the upper portion of the film resistor is extended above the electrodes to provide a dome-shaped region as shown at 14D while the lower portion of the film resistor geometry engaged by the termination electrodes 12A and 12B have outwardly flaring side edge intercepts as shown at 14A and 14B starting from the bottom edge 14C. The resistor is trimmed by cutting a notch 13 in the lower edge 14C with a pulsed laser beam and extending the notch 13 along a line which is substantially centered under the apex of the dome-shaped top region 14D of the film resistor. With this design, the upper or top region of the film resistor is extended above the termination electrodes 12A and 12B to increase the trim ratio TR as will be explained more fully hereinafter, and is shaped such that it complements the shape of the lower region lying between the termination electrodes and maintains a constant rate of change in resistance value % ΔR per laser bite and further results in causing the mean length of the effective area of the resistor film to increase with increased trim depth d.

In support of the above allegations, it should be noted that the resistor film geometry shown in FIG. 5C and identified as resistor #7 has a trim ratio TR=4.3 if trimmed to a maximum value d=80% as depicted by curve #7 in FIG. 5 of the drawings. In comparison, the trim ratio TR of resistor #7 verses resistor #6 shown in FIG. 5B is improved by a factor of 4.3/2.5=1.72. The improvement in percentage resistance change obtained by the configuration of resistor #7 in comparison to that of #6 is given by a factor of 4.3−1/2.5−1=2.2. In addition, the fully trimmed resistor configuration shown in FIG. 5C results in increasing the mean path from a value of 0.070" to 0.085".

The film resistor geometry shown in FIG. 5D and identified as resistor #8 in the graph shown in FIG. 5, is an extension of the attributes of resistor #7 shown in FIG. 5C. The film resistor geometry shown in FIG. 5D provides a dome-shaped top region 14D which comprises essentially an elongated semi-elliptical configuration. Curve #8 in FIG. 5 shows the improvement in extending the trim ratio TR obtained by thus elongating the dome-shaped top region in contrast to the trim ratio TR characteristics obtained with the film resistor geometry of FIG. 5C employing a less deeply extended dome-shaped top region 14D. In contrasting the trim ratio characteristics of resistor #8 shown in FIG. 5D to resistor #4 shown in FIG. 4D at a trim depth d=80%, it will be seen that the trim ratio is improved by a factor of 6/2.5=2.4, the change in resistance value by a factor 6−1/2.5−1=3.3 and the mean path of effective resistor surface is increased from 0.070" to 0.100".

FIG. 5E is a schematic illustration of the novel film resistor horizontal geometry made available by the invention. In FIG. 5E, it will be seen that the outwardly flaring side edge intercepts of the film resistor with the film conductor terminations preferably lie within a range of values defined by an inner limit shown in solid line form which essentially follows the power function $x_l=(1+K)^w-1+b$ and an outer limit indicated by dotted lines 14A' and 14B' defined by the expression $x_l'=mw+b$ where $x_l$ is the coordinate of the side edge intercept measured along the length of the film resistor geometry (abscissa) as shown in FIG. 5E and w is the coordinate of the side edge intercept measured along the width (ordinate) of the film resistor geometry, m is the slope of the essentially straight line outer limit curve shown at 14A' and 14B' and b and K are constants determined by the desired starting geometry for the film resistor network as dictated by space constraints on the substrate on which such network is formed.

Specifically $$K=\sqrt[W]{\frac{1}{2}-b+1}-1,\ m=\frac{W}{\frac{1}{2}-b},$$

where b is ½ the base of the film resistor, W is the value of the width of the film resistor where it interfaces with the electrode conductors, l is the length of the film resistor measured at the point W on the ordinate.

The dome portion 14D of FIG. 5E is formed to fit the previously defined equation TR=1+% ΔR/laser bites)$^n$. The total height H is as dictated by space constraints on the substrate on which such network is formed. r=H−d=0.020 inches typical. r is the radius of a circle describing the top of the dome at 14D whereas 14E and 14F are straight lines from the point W on the ordinate and ±½ on the abscissa drawn tangent to the circle defined by r. d is the length of the laser slit or cut 13 commencing at the bottom edge and extending upwardly toward the top of the film resistor along a line substantially centered beneath the apex of the dome-shaped top and having a maximum of H−0.020 inches.

It might be noted that while the preferred resistor geometry shown in FIG. 5E utilizes two outwardly flaring side edge intercepts, it is also possible to fabricate improved film resistors according to the invention wherein only a single side edge intercept flares outwardly for those circuit applications where space constraints do not allow outward flaring of both side edge intercepts as preferred. Additionally, it should be noted that while FIG. 5E shows the preferred range of limits for appropriately shaping the outwardly flaring side edge intercepts of the film resistor network, it is also possible to so shape the outwardly flaring side edge intercepts such that each of the intercepts present a concave upward interface as opposed to the concave downward interface depicted by the intercepts 14A and 14B shown in FIG. 5E. By so shaping the side edge intercepts while still providing them with the outwardly flaring characteristic, many of the advantages discussed above and hereinafter in practicing the invention can be obtained; however, it has been determined that if one goes beyond the preferred outer limit defined by the sloping straight line intercepts 14'A and 14'B the linear relationship between the change in resistance value % ΔR per laser pulse begins to degrade thereby complicating control of the trimming operation. Consequently, the limits illustrated in FIG. 5E are preferred.

FIG. 6 of the drawings illustrates a series of curves plotting the trim ratio TR versus the depth of cut d plotted both in milli inches and in number of laser pulses required to reach a corresponding depth d measured in milli inches. For the purpose of this illustration, it is assumed that one laser pulse (bite) removes 0.00025 inches (¼ of a milli inch) of resistor material which is what is essentially experienced in practice for the laser parameters discussed with relation to FIG. 3 of the drawings. By making this transition it is possible to express the trim ratio TR in terms of laser bites which is more meaningful than percentages. Additionally, it is important to note that the characteristics of the resistor configuration shown in FIG. 4A and FIG. 5B (resistors #1 and #6) where l/w=2 and l/w=1, respectively, will not improve with increased size so long as the condition l/w is held constant.

In considering the curves shown in FIG. 6, it should be noted that the trim ratio TR characteristic of the resistors shown in FIG. 4C (#3) and FIG. 5C (#7) can be extended by suitable modification of the dome-shaped top region to equal the TR of resistor #8 thereby obtaining all of the improvements in trim ratio TR, percentage change in resistance value % ΔR and increase in the fully trimmed mean path as previously described with relation to FIGS. 5C and 5D. This can be appreciated best in FIG. 6 wherein it can be seen that by comparing the trim ratio TR of resistors #3, #7 and #8 versus d in terms of laser bits or milli inches, they all fall on the same curve.

Figure 7:
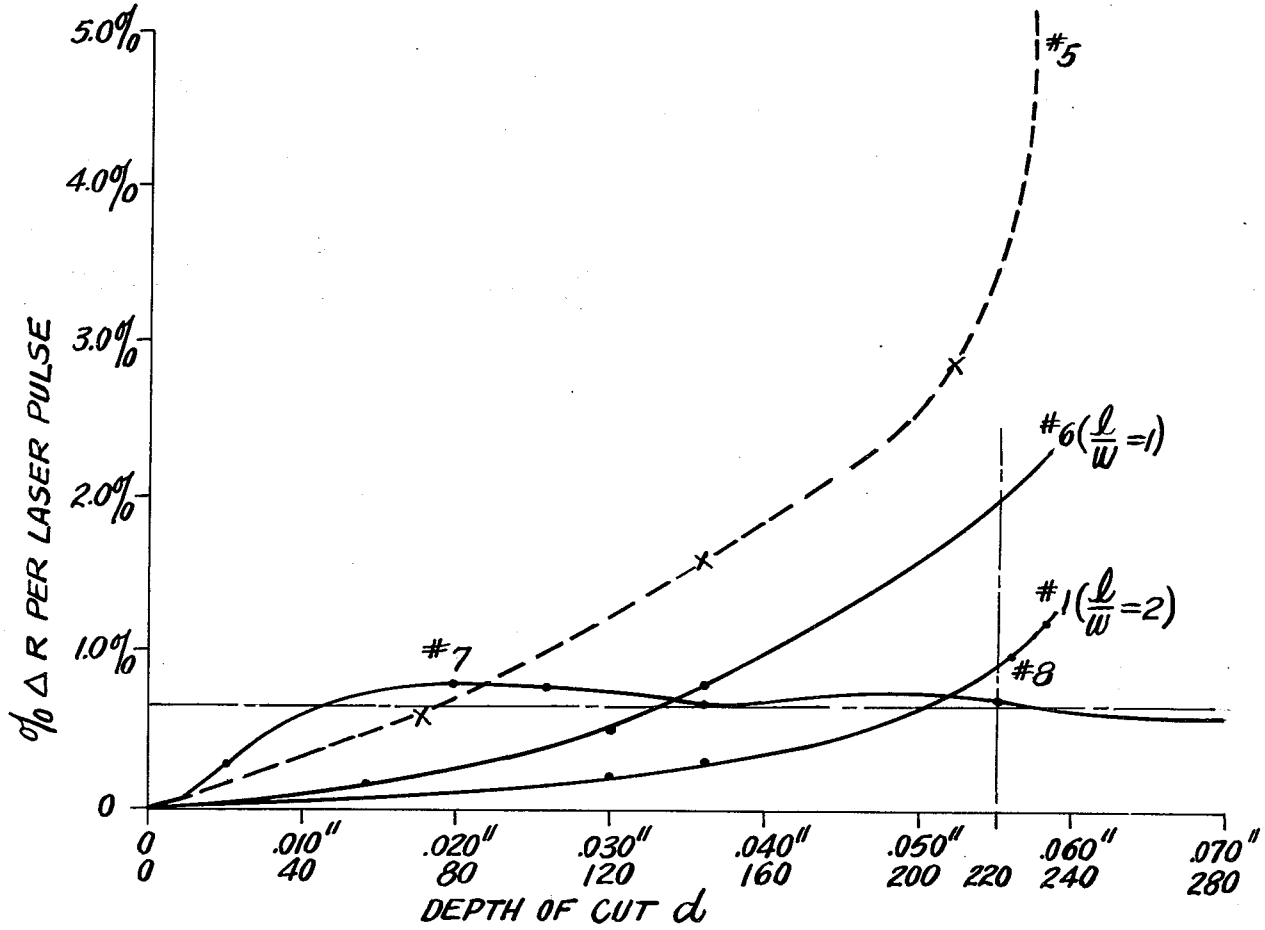
FIG. 7 is a characteristic curve showing the percent change in resistance (%/ΔR) per laser pulse versus depth of cut characteristic for the several film resistor network horizontal geometries shown in FIGS. 4A–4D and 5A–5D.

FIG. 7 is a graph plotting the percent change in resistance per laser pulse versus the depth of cut d plotted both in milli inches and in numbers of laser pulses or bites. The ideal % ΔR per laser bite curve would be a straight line as shown at the 0.65% line. The formula for a constant % ΔR is given by the expression TR=(1+0.0065)$^n$ where n equals the number of laser cutting pulses or bites. On FIG. 6 it should be noted with respect to these curves, the film resistor horizontal geometries shown in FIG. 5C (resistor #7) and in FIG. 5D (resistor #8) meet the conditions expressed by the above-noted equation at the following points:

0.020" or 80 laser bites, TR=$(1+0.0065)^{80}$=1.67

0.040" or 160 laser bites, TR=$(1+0.0065)^{160}$=2.82

0.050" or 200 laser bites, $TR=(1+0.0065)^{200}=3.65$
0.055" or 220 laser bites, $TR=(1+0.0065)^{220}=4.12$
end of resistor #7, begin resistor #8
0.060" or 240 laser bites, $TR=(1+0.0065)^{240}=4.73$
0.070" or 280 laser bites, $TR=(1+0.0065)^{280}=6.14$ From the above tabulation it will be appreciated that both film resistor horizontal geometries shown in FIGS. 5C and 5D follow the expression $TR=(1+\% \Delta R/\text{laser bites})^n$. It should further be noted from FIG. 7 that the actual rate of change of resistance (% ΔR) for resistors #7 (FIG. 5C) and #8 (FIG. 5D), is a fairly good approximation of a constant rate except in the first 0.008", due to the practical edge effect problems. It should be further noted that the prior art resistor shown in FIG. 4A (resistor #1) has a very slow rate of change until the last 0.005" for the depth d from 0.050" to 0.055". The film resistor geometry shown in FIG. 5B (resistor #6) also starts out very slowly, passes through the characteristic of resistor #7 at about d=0.034" and then increases to % ΔR/laser bites=2% at about 0.055". Consequently, the configuration of resistor #1 and resistor #6 are too slow in the beginning, and resistor #6 is to fast at the end in order practically to fit a 1% tolerance value with respect to the nominal rated value of the end resistor. A practical solution for properly trimming a film resistor horizontal geometry such as that of resistor #6 (FIG. 5B) is to stop d at 90% of the intended value and then take an extra vernier by an "L" cut or a second plunge cut as taught in U.S. Pat. No. 3,947,801. Such measures, however, reduce throughput and complicate programming the computer controlled laser beam trimmer. In comparison, as is shown in FIG. 6, the film resistor horizontal geometry shown in FIG. 5C (resistor #7) reaches the same value of trim ratio (TR) at d=0.023" or 92 laser pulses in contrast to resistor #1 (FIG. 4A) which does not reach the same value of trim ratio TR until d=0.055" or 220 laser pulses. It should be further noted that the #7 resistor horizontal geometery reaches the same value of trim ratio TR at d=0.036" or 144 laser pulses in comparison to resistor configuration #6 (FIG. 5B) which requires d=0.055" or 220 laser pulses to obtain the same value of trim ratio TR.

Figures 8, 11, 12, 13:
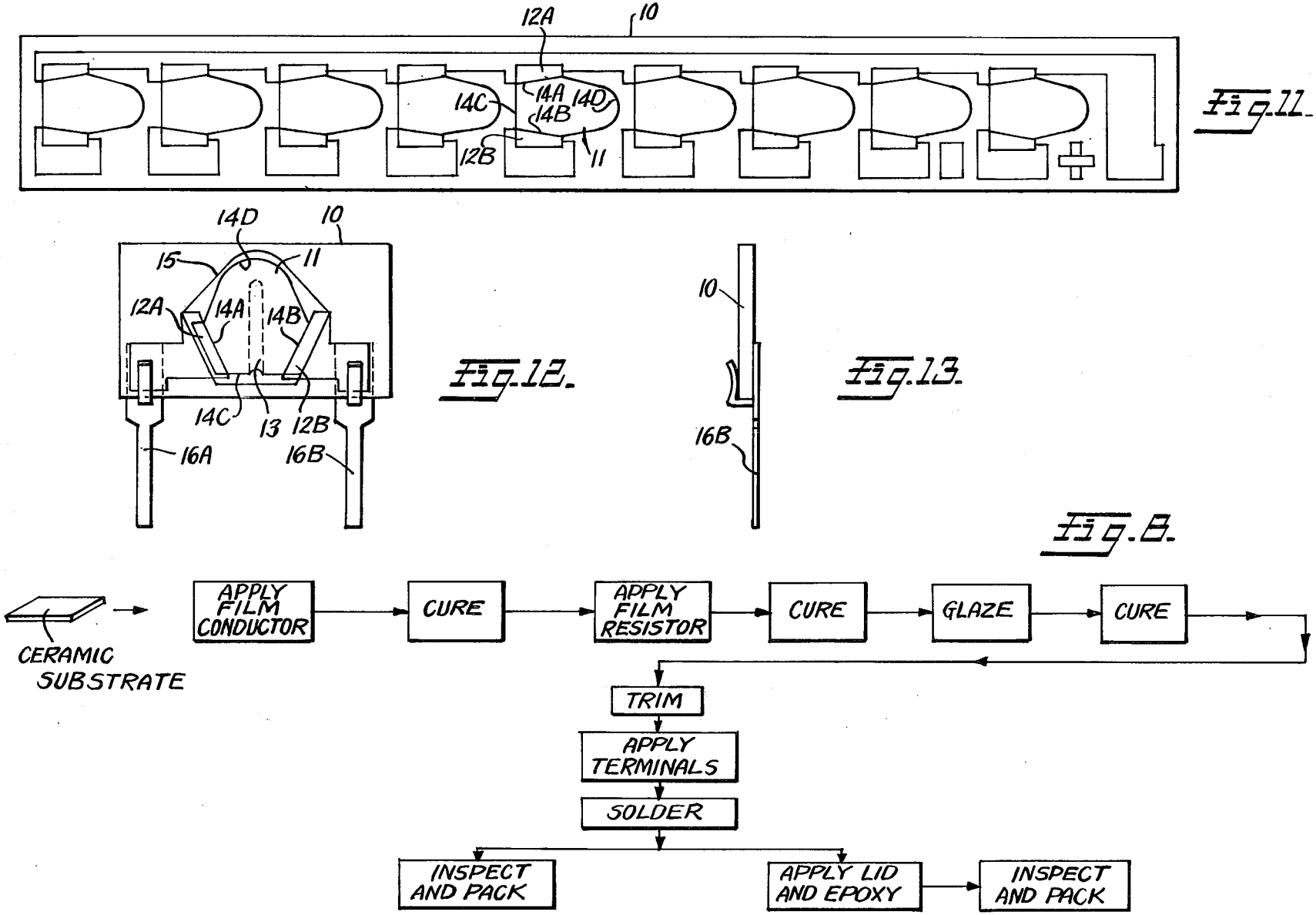
Figure 9:
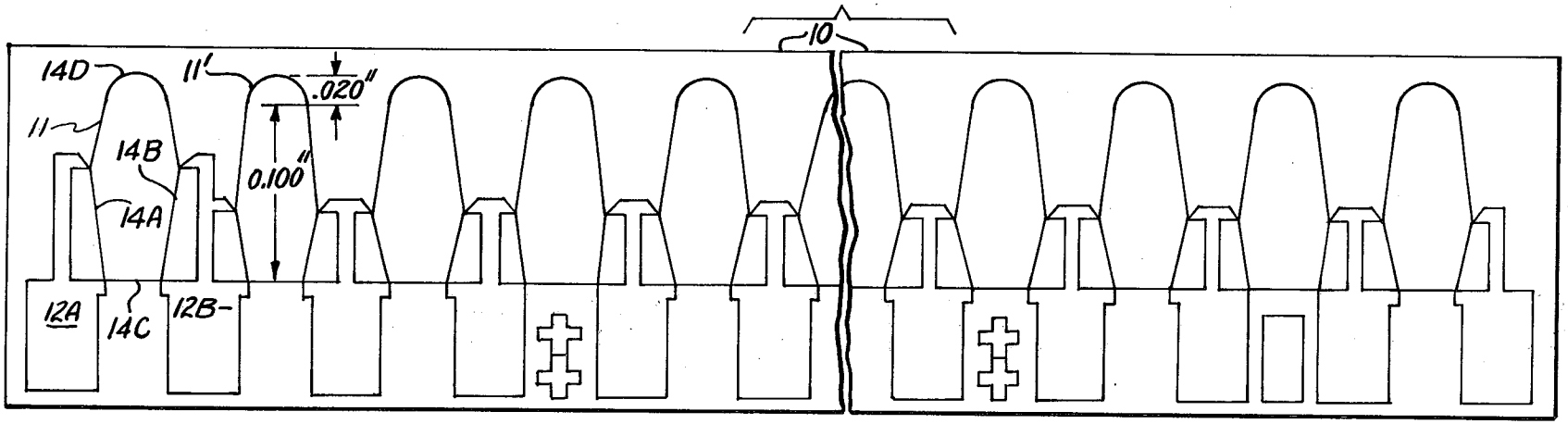

FIG. 8 of the drawings is a simplified functional block diagram of the processing steps employed in the fabrication of thick film resistors utilized in practicing the invention. At this point in the description, it should be kept in mind that whle the invention has been described with relation specifically to thick film resistor network applications, it applies with equal force to the trimming of thin film resistor networks fabricated with entirely different techniques by processes well known in the art of hybrid integrated circuit manufacture. The starting material employed in the simplified process depicted in FIG. 8, is a ceramic substrate of alumina of about 0.01" thickness such as are manufactured and sold commercially by the American Lava Corporation a subsidary of the 3-M Company and Coors Porcelain Company of Golden, Colorado. After suitable pretreatment, a pattern of film conductor electrode is formed on at least one surface of the substrate through appropriate photographically developed silk screen masks in a well known manner. For a description of suitable film conductor compositions, techniques for developing a silk screen mask, film resistor compositions, curing temperatures and periods, glazes, solders and the like reference is made to the publication entitled "Thick Film Handbook" published by the Photoproducts Department, Electronics Materials Division of the E. I. DuPont de Nemours & Co., Inc., Wilmington, Delaware 19898. This handbook describes in detail all of the steps illustrated in the simplified functional block diagram of FIG. 8 and the disclosure thereof is hereby incorporated in its entirely for a full and detailed teaching of the best manner of fabricating film resistor networks used in practicing the present invention. After curing of the film conductor, the film resistor composition is applied to the substrate through suitable photographically developed silk screens devised in accordance with the teachings of the present invention to provide the desired horizontal geometry which is the subject of this disclosure and thereafter cured. At this point a suitable impervious coating usually in the form of a fired glass composition is placed over the film resistor portions of the network and the glaze thereafter cured. At this point in the processing, the individual resistors on each ceramic substrate are trimmed pursuant to the method of trimming disclosed in FIG. 8A to be described hereafter. Following the trimming step, suitable terminals are applied to the film conductor electrode of the film resistor network and preferably soldered. At this stage in the processing, certain of the resistor networks may be used without further processing and hence are tested, inspected and packed for shipment to the ultimate user. Others of the network have a lid in the form of a substrate member of similar material to the starting ceramic substrate applied over the film resistor network by a suitable epoxy resin and then inspected, tested and packed for shipment to the user.

FIG. 8A is a simplified functional block diagram of the computer controlled laser trimming system employed in trimming the thick film resistor networks fabricated in accordance with the invention by utilizing the processing steps outlined in the simplified block diagram of FIG. 8. An untrimmed thick film resistor is shown at 11 formed on an underlying substrate 10 together with the film conductor electrodes 12A and 12B. The electrodes are engaged by suitable Kelvin probes which are connected to a selection switching matrix 21 under the control of a computer 22. Output signals from the probes are supplied through the switching matrix 21 to the input of an electronic Wheatstone measuring system 23 whose output in turn is supplied to the control computer 22 and which is supplied with a desired resistance value from the computer in order to determine which standard value any given film resistor network is to be trimmed to. This decision is of course made by the computer after first receiving input signals from the electronic Wheatstone bridge measuring system 23 supplying it with an initial value of resistance for the film resistor network under test. For this purpose, appropriate programming of the control computer is achieved through a keyboard entry indicated at 24, a tape memory indicated at 25 or from some other suitable data bank indicated at 26 for appropriately programming the computer to control the trimming system in accordance with the requirements of any given resistor network design.

The control computer 22 controls the application of the pulsed cutting laser beam to the film resistor 11 starting at the lower edge 14C thereof. The laser beam is indicated by a dash-dot line and is emitted by a YAG laser rod 31 in conjunction with a back reflecting mirror 32, a quartz electronic switch 33, suitable x and y stepping mirrors 34 and 35 under the control of x and y servo mechanisms 37 and 38, respectively, that in turn are controlled by the computer control system 22 to cause the pulsed laser beam to exit through lens 36 and impinge upon a desired point on the surface of the film resistor 11 being trimmed. The YAG laser upon being energized, lazes continuously through interaction with the back reflecting mirror and the beam thus produced is emitted in pulses of monochromatic light under the control of the quartz electronic switch. The frequency at which the electronic switch in actuated is under the control of the computer 22 and determines the frequency of the emitted pulsed laser cutting beam transmitted through the output lens 36 and caused to impinge upon resistor film 11. Limited movement of the emitted pulsed laser cutting beam is achieved through the x–y stepping mirrors 34 and 35 which in turn are under the control of the computer control system 22 to cause the laser beam to cut the notch 13 to a depth d required in order to result in a final trimmed resistance value called for by the computer after the initial testing thereof. Upon attaining this value, the laser beam is cut off by means of the electronic switch 33 and thereafter the next untrimmed film resistor network is moved into place by a suitable x–y positioning table (not shown) likewise under the control of the computer control system 22.

Figure 9:
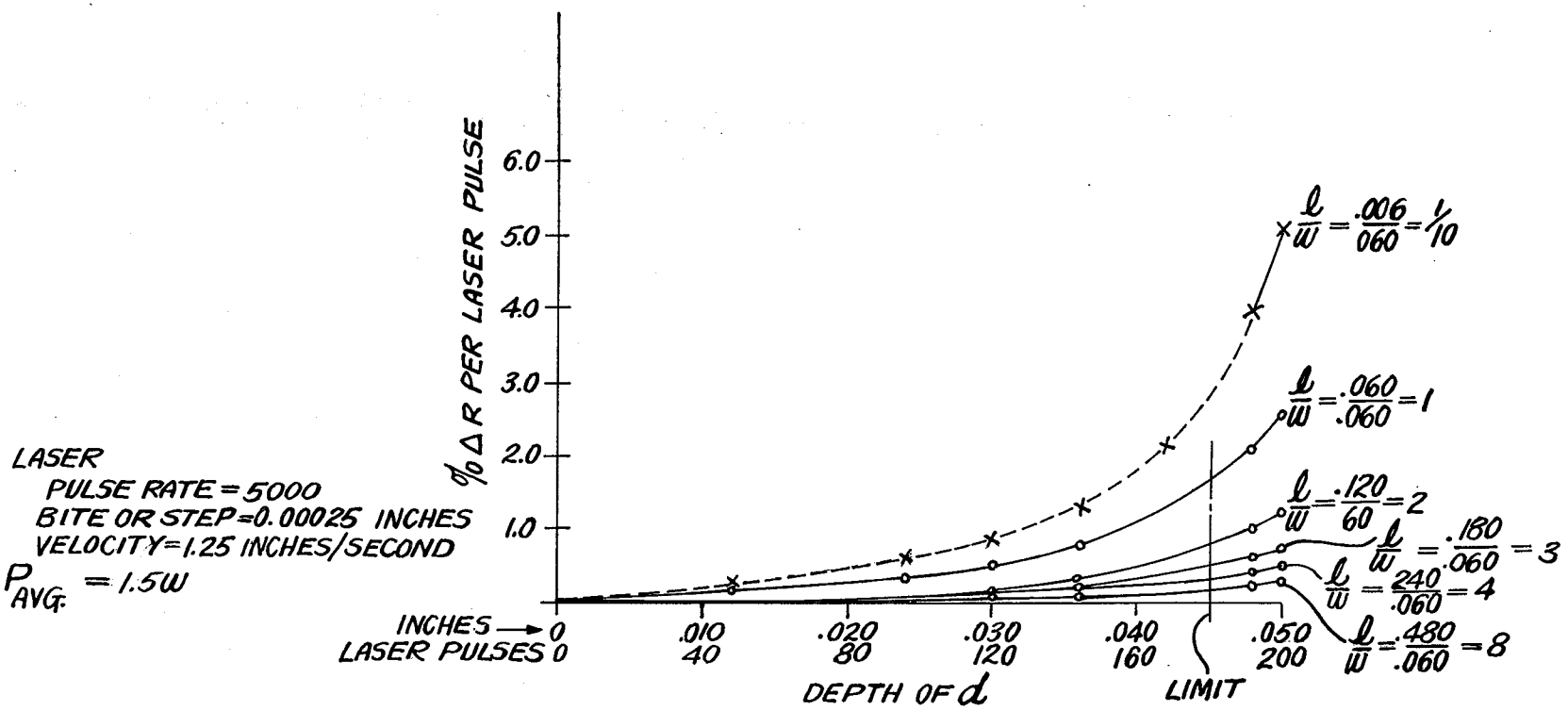
FIG. 9 is a planar view of the layout of one form of single-inline-package (SIP) film resistor network designed according to the invention.

As an example of the trimming operation, FIG. 9 shows a resistor network according to the invention having a maximum width w dimension at the apex of the dome-shaped top region of 0.12". In order to assure a minimum remaining resistor path of 0.020", the maximum depth of the trimming notch can be d=0.10". From the equations described previously, $TR=(1.00563)^{400}=9.44$, where 400 comes from four laser bites per milli inch (0.00025" per laser bite) and 100 milli inches, and the ideal % Δ R per laser bite will calculate out to be 0.563%. Using these values, one could stop on any one of the 400 laser pulses and be within 0.563% of the target resistance value. 0.5% is a practical value to trim to in order that the final test after packaging can be done within the 1% of nominal rated value standard. These values are required in order to assure that the final product will remain within + or −2% during field application and allow for a load life of + or −1%. Actual test results have proven that these are practical figures obtainable with the computer controlled laser trimming system shown in FIG. 8A utilizing the novel film resistor network horizontal geometry made available by the invention.

FIG. 9 of the drawings is a planar view of the layout of a multiple component film resistor network fabricated in accordance with the invention on a single insulating substrate 10 having the standard TO-116 dimension of 0.75" by 0.25". It will be appreciated from FIG. 9 that a large number of individual film resistor elements can be formed on a single substrate member of such small dimensions. Each individual film resistor element such as those shown at 11 and 11' of FIG. 9 has a horizontal geometry similar to that depicted and described with relation to FIGS. 5C, 5D and 5E as denoted by the corresponding reference numerals used in describing those figures. One notable exception lies in the fact that a common film conductor electrode 12B–12A is employed for the two adjacent film resistor elements as shown at 11 and 11'. Additionally, it will be noted that film conductor electrodes 12A and 12B associated with the film resistor element 11 extend for a greater proportion of the width w of film resistor element 11 than do the corresponding electrodes associated with the film resistor element 11'. By this means, widely divergent resistance values after trimming can be obtained between two film resistor deposits of otherwise similar size and composition. This variation considered in conjunction with the greatly increased or extended range of trim ratio obtained by the novel horizontal geometry of the present invention, provides the manufacturer with means for greatly improving yield from a given batch processing operation using a single resistivity composition.

Figure 10:
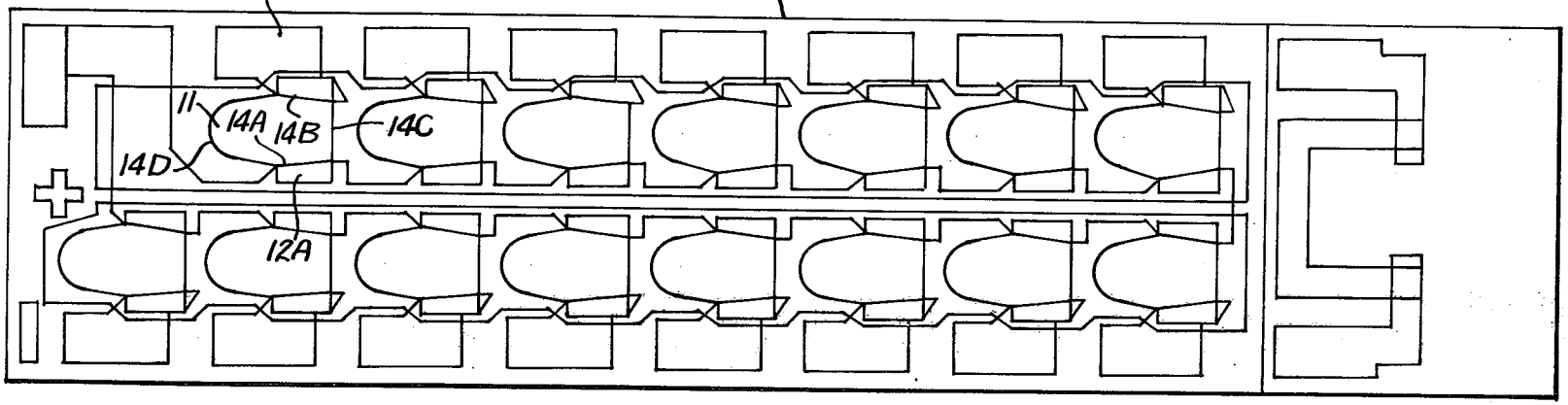
FIG. 10 is a planar view of the layout of a dual-inline-package (DIP) film resistor network design according to the invention.

FIGS. 10 and 11 of the drawings likewise are planar views of alternative, multiple component film resistor networks fabricated in accordance with the invention and further illustrate the wide variety of multiple element network configurations that can be provided in accordance with the teachings of the invention. In FIGS. 10 and 11 the same reference numerals are used to identify parts of a number of similar, respective film resistor networks described earlier with respect to FIGS. 5C, 5D and 5E and serve to illustrate the manner in which the novel film resistor horizontal geometry is employed in two widely different multiple component film resistor networks.

FIGS. 12 and 13 are respective planar front and side views of a single element film resistor network fabricated on an insulating substrate member 10 having dimensions of length l=0.5" and w=0.25". By this means, film resistors having relatively large trim ratios can be provided for use by hybrid integrated circuit manufacturers for active trimming. FIGS. 12 and 13 also serve to illustrate the manner in which a fired glass passivating coating shown at 15 in FIG. 12 may be employed to encapsulate the film resistor network and provide it with an impervious coating for protective purposes. Additionally, FIGS. 12 and 13 shows how terminals 16A and 16B are mechanically clamped to the film conductor electrode areas 12A and 12B and thereafter may be soldered in order to assure good electrical connection of the terminals to the film conductor electrodes.

From the foregoing description it will be appreciated that the novel film resistor network horizontal geometry made available by the present invention results in less wasted or unused resistor material from before to after trimming as clearly evident from a comparison of FIG. 1 of the drawings to FIGS. 5C–5E. It should be noted that in the prior art rectangular resistor geometry, the more it is trimmed the greater becomes the lost or unused resistor material as the active area of the resistor material decreases. This is in contrast to the present invention as shown in FIGS. 5C–5E wherein it can be seen that the more these configurations are trimmed, the more additional resistor material comes into active use. Due to the plus or minus 20% process spread in the initial resistance value of the fired film resistor prior to trimming, as a practical matter all film resistors must be trimmed to avoid yield losses. For example, for a final trimmed resistance value of 1 unit of resistance, the process is set at 0.8±0.2. Thus the average trim is 0.2/0.8=25% and maximum becomes 0.4/0.6 or 67%. Therefore, the rectangular film resistor configuration must accommodate the 67% trim or 1.67 to 1 trim ratio TR just to meet the nominal after trim value. As shown in FIG. 5, the trim ratio of the novel film resistor horizontal geometries made available by the invention is of the order of 6 to 1. Similarly the resistor in FIG. 9 has a 9.44 to 1 trim ratio as described on page 27, lines 13–18. The obvious advantage of this increase in trim ratio is that it allows the initial resistance value of the fired film resistor prior to trimming to be trimmed to include 7 or 8 standard resistance values as listed on page 11 of the specification in contrast to the prior art trim configurations which allowed only 1 to 3 at most standard resistance values to lie within the trimming range of the initial resistance values of such film resistor configurations.

The more efficient use of resistor material obtained by reason of the novel film resistor horizontal geometry is of particular importance to film resistor networks requiring a range of non-similar resistance values. This results in much less wasted material after trimming. Since material costs are approximately $50 per oz. times 0.0036 sq. inches/400 sq. inches per oz. amounts to 0.00045 dollars per resistor. In dollars per thousand for a sixteen pin, 15 resistor network the cost comes to $6.75. The savings amounts to about 10% of the total package material costs and is quite consequential. In addition, better power capacity is obtained in that with the prior art configuration the power capacity is reduced to about 33% of its original capacity in contrast to the configurations of the invention wherein the power capacity is increased to 250% greater than the original power capacity. These factors in addition to the greatly improved trim ratios are important additional features of the invention.

From a comparison of the operating characteristics of fully trimmed resistors according to the present invention as contrasted to the operating characteristics of fully trimmed prior art resistors according to FIG. 1, additional improvement will be noted in terms of current distribution, voltage gradient and the consequent thermal gradient. As reported in the above cited 1976 Proceedings of the International Microelectronics Symposium paper entitled "Power Rating Prediction and Evaluation in Thick Film Resistors", the prior art configuration can result in current crowding which produces undesirable hot spots. The hot spots shorten the operating life of the film resistor, reduce the power capacity, increase drift and degrade the apparent tolerance due to the self-heating effect being amplified by the temperature coefficient of resistance of the resistor. In contrast, the novel horizontal geometry made available by the invention results in longer resistor life, less load life drift, increased power capacity, lower temperature coefficient of resistance (TCR) self-heating, lower effects and consequently greater precision in circuit applications together with lower internal thermal coefficient of heat transfer.

In addition to the above discussed desirable attributes, the higher trim ratios made possible by the new horizontal geometry make for ease of production, higher yield and allow multiple resistor values to be produced on a single network substrate using one resistivity material blend. This results in the ability to provide a larger range of resistance values in a given size package such as the TO-116 DIP and SIP packages. It allows for more flexibility in fabrication and allows inventoring of un-known orders for specific resistance values with pretrimmed film resistor networks capable of being trimmed to such values thereby allowing shorter delivery times. The higher trim ratio also results in lower cost through layer effective lot or batch sizes and reduction of the number of resistivity material blends required at pre-screening which normally are received in decade values plus or minus 10%. Considerable economy is achieved as a result of the capability of determining resistance values by simple modification of the computer controlled trimming laser software as opposed to the difficult and exacting process of blending resistivity materials and send-ahead testing.

The accuracy and speed of laser trimming made possible by the invention is best illustrated with respect to FIG. 11 of the drawings which shows a mini-SIP containing nine resistors and ten terminal pins. Each resistor must be ⅛ to ¼ watt, therefore, the rectangular configuration used in the prior art would not work due to the small ceramic real estate of the underlying substrate 10 which is only 0.13" wide. In addition to this requirement, 0.01" of space is required on all edges and has to be maintained to permit laser scribing for snapping apart such structures from a larger substrate member on which large numbers of such multiple component resistor networks are formed in a single screening operation. This results in a working width of approximately 0.110". Given the laser parameters of 5,000 pulses per second and a step or bite size of 0.00025" (the spot size of the laser beam is 0.001 to 0.002"), the greatly improved trim ratio TR of 6.5 to 1 or 650% allows the individual film resistor network elements to be trimmed over a wide range of values up to a maximum depth d which leave 0.020" short of the end of the resistor elements such that the mean width of the fully trimmed resistor paths is greater than or equal to 0.020". The computer controlled laser and measurement system shown in FIG. 8A operates in a finite sequence such as pulse, measure, pulse, measure, etc. until the target nominal resistance value is reached within 1%. For the multiple component film resistor network shown in FIG. 11, the 0.065" depth of cut d limited the cutting operation to 260 laser pulses. If the trim ratio TR is to be 650% via 260 laser pulses, then each and every laser pulse should produce a 1% change in resistance value. Thus, $\Delta R/R$ must be a constant as is made possible with the new horizontal geometry, and the trim ratio equation TR becomes $TR=(1+\Delta R/\text{laser bite})^n$ and n equals length/laser bite=0.065"/0.00025"=260. Substituting the above numbers in the TR equation, i.e. $6.5=(1+\% \Delta R)^{260}$ and solving for % $\Delta R$ results in % $\Delta R$ equal 0.00728 or 0.728%. Utilizing these values, and by so tailoring the resistivity materials employed in the fabrication of the individual film resistor element on the multiple component network of FIG. 11, the network was trimmable to within the range of resistance values required. This was achieveable only because of the novel horizontal geometry made available by the invention which provided the extended or high trim ratio together with a substantially constant % $\Delta R$/laser bite which is nondivergent.

From the foregoing discussion, it will be appreciated that the invention provides a new and useful film resistor network horizontal geometry which makes possible much higher trim ratios than heretofore obtainable with known film resistor network geometries of given dimensions and which possesses superior operating characteristics after trimming. The novel film network geometry further enables improved manufacturing and trimming techniques which greatly improve throughput and yields obtained from any given batch processing operation during manufacture of such networks.

Having described several embodiments of the novel film resistor network horizontal geometry fabricated in accordance with the invention, it is believed obvious that other modifications and variations of the invention will be suggested to those skilled in the art in the light of the above teachings. It is therefore to be understood that changes may be made in the particular embodiments of the invention described which are within the full intended scope of the invention as defined by the appended claims.

What is claimed is:

1. A film resistor network geometry having improved trimming and operating characteristics comprising an insulating substrate having at least one film resistor formed thereon and a pair of opposed film conductor electrodes disposed on opposite sides of the film resistor, said film resistor comprising a tapered lower region adjoining a dome-shaped top region, the side edge intercepts of the film resistor engaged by said film conductor electrodes flaring outwardly from the bottom edge of said film resistor at least on one side thereof to form the tapered lower region, said film conductor electrodes terminating at the junction of the tapered lower region with the dome-shaped top region of said film resistor whereby the dome-shaped top region is not engaged by said film conductor electrodes, said film resistor being trimmed by cutting a notch in the film resistor from the bottom edge thereof.

2. A film resistor network geometry according to claim 1 wherein the notch cut in the film resistor for trimming purposes is in the form of a fine silt or kerf produced by laser beam cutting commencing at the bottom edge and extending upwardly toward the dome-shaped top region along a line substantially centered beneath the apex of the dome-shaped top.

3. A film resistor network geometry according to claim 1 wherein the dome-shaped top region of the film resistor has an elongated semi-elliptical configuration.

4. A film resistor network geometry according to claim 1 wherein the film resistor possesses a trim ratio (TR) characteristic in accordance with the expression:

$$TR=(1+\%\ \Delta R/\text{laser bite})^n$$

where % ΔR/laser bite represents the change in resistance of the film resistor produced by each cutting laser beam pulse or bite and n is the number of laser bites, and wherein the % ΔR per laser bite is substantially constant over an extended range of values of trim ratio (TR) for a film resistor network of given physical dimensions and having a given value of initial resistance.

5. A film resistor network geometry according to claim 2 wherein the dome-shaped top region of the film resistor has an elongated semi-elliptical configuration and the film resistor possesses a trim ratio (TR) characteristic in accordance with the expression:

$$TR=(1+\%\ \Delta R/\text{laser bite})^n$$

where % ΔR/laser bite represents the change in resistance of the film resistor produced by each cutting laser beam pulse or bite and n is the number of laser bites, and wherein the % ΔR per laser bite is substantially constant over an extended range of values of trim ratio (TR) for a film resistor network of given physical dimensions and having a given value of initial resistance.

6. A film resistor network geometry according to claim 1 wherein the outwardly flaring side edge intercepts of the film resistor lie within a region having an outer limit defined by the expression $X_l=mw+b$ and an inner limit defined by the expression $X_l=(1+K)^w-1+b$ where $X_l$ is the coordinate of the side edge intercept along the length of the film resistor geometry (abscissa) and w is the coordinate along the width (ordinate), m is the slope of the essentially straight line outer limit and b and K are constants determined by the desired starting geometry of the film resistor network as dictated by space constraints on the substrate.

7. A film resistor network geometry according to claim 6 wherein the notch cut in the film resistor for trimming purposes is in the form of a fine slit or kerf produced by laser beam cutting commencing at the bottom edge and extending upwardly toward the dome-shaped top region along a line substantially centered beneath the apex of the dome-shaped top.

8. A film resistor network geometry according to claim 7 wherein the dome-shaped top region of the film resistor has an elongated semi-elliptical configuration.

9. A film resistor network geometry according to claim 8 wherein the film resistor possesses a trim ratio (TR) characteristic in accordance with the expression:

$$TR=(1+\%\ \Delta R/\text{laser bite})^n$$

where % ΔR/laser bite represents the change in resistance of the film resistor produced by each cutting laser beam pulse or bite and n is the number of laser bites, and wherein the % ΔR per laser bite is substantially constant over an extended range of values of trim ratio (TR) for a film resistor network of given physical dimensions and having a given value of initial resistance.

10. A film resistor network geometry according to claim 9 wherein said film resistor is encapsulated in an impervious protective coating and terminals are mechanically and electrically connected to the film conductor electrodes.

11. A film resistor network geometry according to claim 9 wherein there are a plurality of similarly shaped electrically isolated individual film resistor networks formed on a single substrate and interconnected in a multiple component resistor network by appropriate interconnecting film conductors formed on said substrate along with said film resistor networks.

12. A film resistor network geometry according to claim 11 wherein said film resistor networks and interconnecting conductors are encapsulated in an impervious protective coating and terminals are mechanically and electrically connected to respective ones of the film conductor electrodes.

13. A film resistor network geometry according to claim 11 further including a lid comprised by an additional substrate member disposed over the film resistor networks and interconnecting film conductor covered surface of the first mentioned substrate in the manner of a sandwich and terminals mechanically and electrically connected to respective ones of the film conductor electrodes of the film resistor networks.

14. A new and improved method of manufacture and trimming film resistor networks having improved horizontal geometry comprising forming on a substrate at least one film resistor having a pair of opposed film conductor electrodes disposed on opposite sides of the film resistor with the film resistor comprising a tapered lower region adjoining a dome-shaped top region, the side edge intercepts of the film resistor engaged by the film conductor electrodes flaring outwardly from the bottom edge of the film resistor at least on one side thereof to form the tapered lower region, said film conductor electrodes terminating at the juncture of the tapered lower region with the dome-shaped top region whereby the dome-shaped top region is not engaged by the film conductor electrodes, and trimming the film resistor network thus formed with a laser beam by cutting a fine slit notch completely through the film resistor starting from the bottom edge thereof along a line substantially centered under the apex of the dome-shaped top whereby a substantially constant rate of change of resistance with trimming is achieved from start to finish, an extended trim ratio is obtained and the mean length of the effective resistor path is increased with increased trim depth.

15. The method of claim 14 wherein a computer controlled pulsed laser cutting beam is employed to provide the substantially constant rate of change of resistance with trimming by providing substantially equal laser beam cutting bites from the film resistor both at the beginning and for the full depth of the laser beam cut trimming notch.

16. The method according to claim 15 wherein the dome-shaped top region of the film resistor has an elongated semi-elliptical configuration.

17. The method according to claim 15 wherein the film resistor possesses a trim ratio (TR) characteristic in accordance with the expression:

$$TR=(1+\%\ \Delta R/\text{laser bite})^n$$

where % ΔR/laser bite represents the change in resistance of the film resistor produced by each cutting laser beam pulse or bite and n is the number of laser bites, and wherein the % ΔR per laser bite is substantially constant over an extended range of values of trim ratio (TR) for a film resistor network of given physical dimensions and having a given value of initial resistance.

18. The method according to claim 14 wherein the outwardly flaring side edge intercepts of the film resistor lie within a region having an outer limit defined by the expression $X_l=mw+b$ and an inner limit defined by the expression $X_l=(1+K)^w-1+b$ where $X_l$ is the coordinate of the side edge intercept along the length of the film resistor geometry (abscissa) and w is the coordinate along the width (ordinate), m is the slope of the essentially straight line outer limit and b and K are constants determined by the desired starting geometry of the film resistor network as dictated by space constraints on the substrate.

19. The method according to claim 18 wherein the dome-shaped top region of the film resistor has an elongated semi-elliptical configuration.

20. The method according to claim 19 wherein the film resistor possesses a trim ratio (TR) characteristic in accordance with the expression:

$$TR=(1+\%\ \Delta R/\text{laser bite})^n$$

where % ΔR/laser bite represents the change in resistance of the film resistor produced by each cutting laser beam pulse or bite and n is the number of laser bites, and wherein the % ΔR per laser bite is substantially constant over an extended range of values of trim ratio (TR) for a film resistor network of given physical dimensions and having a given value of initial resistance.

21. The method according to claim 20 further comprising mechanically connecting terminals to respective ones of the film conductor electrodes, soldering the terminals to the film conductor electrodes to which they are connected, coating the film resistor network with an impervious protective coating, and curing the protective coating.

22. The method according to claim 20 wherein a plurality of similarly shaped electrically isolated individual film resistor networks are formed on a single substrate and interconnected in a multiple component resistor network by appropriate interconnecting film conductors formed on the same substrate along with said film resistor networks.

23. The method according to claim 22 further comprising mechanically connecting terminals to respective ones of the film conductor electrodes to which they are connected, coating the film resistor network with an impervious protective coating, and curing the protective coating.

24. The method according to claim 22 further comprising mechanically connecting terminals to respective ones of the film conductor electrodes, soldering the terminals to the film electrodes and applying an additional substrate member over the film resistor networks and interconnecting film conductors by means of a suitable adhesive.

25. The product of the method of manufacture according to claim 14.

26. The product of the method of manufacture according to claim 18.

27. The product of the method of manufacture according to claim 20.

28. The product of the method of manufacture according to claim 21.

29. The product of the method of manufacture according to claim 23.

30. The product of the method of manufacture according to claim 24.

* * * * *